US005755476A

United States Patent [19]

Hosking

[11] Patent Number: 5,755,476

[45] Date of Patent: May 26, 1998

[54] HOIST LOCK

[76] Inventor: John Hosking, 451 Sunset Drive, Oakville, Ontario, Canada, L6L 3N3

[21] Appl. No.: 722,958

[22] Filed: Sep. 27, 1996

[51] Int. Cl.[6] ..... B66C 1/42

[52] U.S. Cl. ..... 294/106; 294/110.1; 294/117

[58] Field of Search ..... 294/106–109, 294/110.1, 115, 117, 118

[56] References Cited

U.S. PATENT DOCUMENTS

| | | | |
|---|---|---|---|
| 72,232 | 12/1867 | Shade | 294/109 |
| 255,546 | 3/1882 | Stephens | 294/117 |
| 706,324 | 8/1902 | Lafferty . | |
| 748,222 | 12/1903 | Sites . | |
| 1,015,057 | 1/1912 | Mitchell . | |
| 1,129,664 | 2/1915 | Gilchrist et al. . | |
| 1,220,899 | 3/1917 | Sorensen | 294/115 |
| 1,280,951 | 10/1918 | Blackmarr . | |
| 1,356,515 | 10/1920 | Burgson . | |
| 2,087,877 | 7/1937 | Ralston et al. | 294/109 |
| 2,348,741 | 5/1944 | Jessen . | |
| 2,378,570 | 6/1945 | Mitchell | 294/110.1 |
| 2,408,719 | 10/1946 | Abernethy . | |
| 2,674,380 | 6/1954 | Boudreaux . | |
| 2,853,336 | 9/1958 | Cruikshank et al. . | |
| 2,857,193 | 10/1958 | Heppenstall . | |
| 2,951,725 | 9/1960 | St. Jean . | |
| 3,451,711 | 6/1969 | Carpenter . | |
| 4,035,010 | 7/1977 | Kawashita et al. . | |
| 4,281,868 | 8/1981 | Lovitt . | |
| 4,863,204 | 9/1989 | Peters | 294/115 |
| 5,000,648 | 3/1991 | Hosking . | |
| 5,364,147 | 11/1994 | Dickey et al. . | |

FOREIGN PATENT DOCUMENTS

| | | |
|---|---|---|
| 111287 | 1/1931 | France . |
| 3904670 | 10/1989 | Germany . |

*Primary Examiner*—Dean Kramer

[57] ABSTRACT

There is provided a gripping device with lifting arms mounted for relative rotational movement on a slider and having free ends spaced from each other and adapted to receive a load there-between. An arm link assembly coupled to the arms is movable between a gripping position and a release position to respectively close the arms to grip a load and to separate the arms to receive a load. An over-center clamp is incorporated into the device to move the arm link assembly between the gripping position and release position and to hold the arm link assembly in the release position for the arms to receive a load.

10 Claims, 1 Drawing Sheet

HOIST LOCK

FIELD OF THE INVENTION

This invention relates to a hoist or gripping device commonly associated with a crane or any other lifting apparatus for moving heavy loads. The device generally comprises a pair of clamping arms connected by a system of links. In particular, the invention relates to locking means for maintaining the clamping arms in a spaced apart configuration adapted to release a load and to allow the crane to be repositioned to grip another load.

BACKGROUND TO THE INVENTION

Various gripping devices are known in which clamping arms are pivotally mounted so that the free ends of the arms that grip a load are brought closer together for a still firmer grip when the load is suspended, for example, by a crane. Conveniently, premature, accidental releases of the load are avoided.

Locking devices provided to maintain the arms in a release configuration ready to be positioned on a load may comprise a notched bar engaged by a pin at a pre-determined separation of the arms as in U.S. Pat. No. 3,451,711 and U.S. Pat. No. 2,853,336 or an interference device for limiting axial movement between a collar carrying the arms and a lifting rod such as in U.S. Pat. No. 1,129,664 and U.S. Pat. No. 2,951,725. These locking devices work well in situations where there is easy access to the apparatus and an operator has the opportunity to assure himself that pins, hooks and collars are positioned in the required location, usually with the assistance of a second operator who must first bring the arms to a release configuration.

The object of this invention is to provide a locking mechanism for gripping devices of the afore-mentioned kind which is easy to position into a release configuration of the arms by one operator only.

SUMMARY OF THE INVENTION

In accordance with this invention, there is provided a gripping device with lifting arms mounted for relative rotational movement and having free ends spaced from each other and adapted to receive a load there-between. An arm link assembly coupled to the arms is movable between a gripping position and a release position to respectively close the arms to grip a load and to separate the arms to receive a load. An over-center clamp coupled to first and second bodies associated with the lifting arms and arm link assembly, respectively, is operable to move the arm link assembly between said gripping position and release position and is adapted to releasably retain the arm link assembly in the release position where the arms are separated to receive a load.

BRIEF DESCRIPTION OF THE DRAWINGS

In order that the invention may be more clearly understood, a preferred embodiment thereof is described with reference to the accompanying drawings, in which.

DESCRIPTION OF PREFERRED EMBODIMENT

Figure 2:
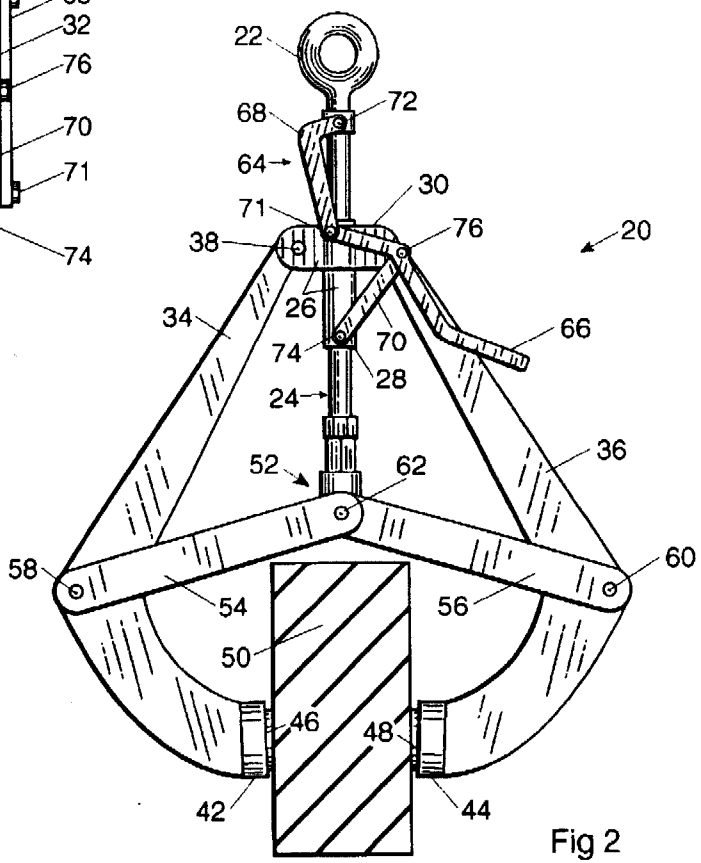
FIG. 2 is a similar view to FIG. 1 with the arm link assembly drawn in a gripping position in association with a load.

A gripping device made in accordance with the invention is generally indicated in the drawings by reference numeral 20. The device 20 is intended to be used in association with a crane or some other lifting apparatus (not shown) and is coupled, in use, to the crane by an "eye" 22 formed at a free end of a shaft 24.

Figure 1:
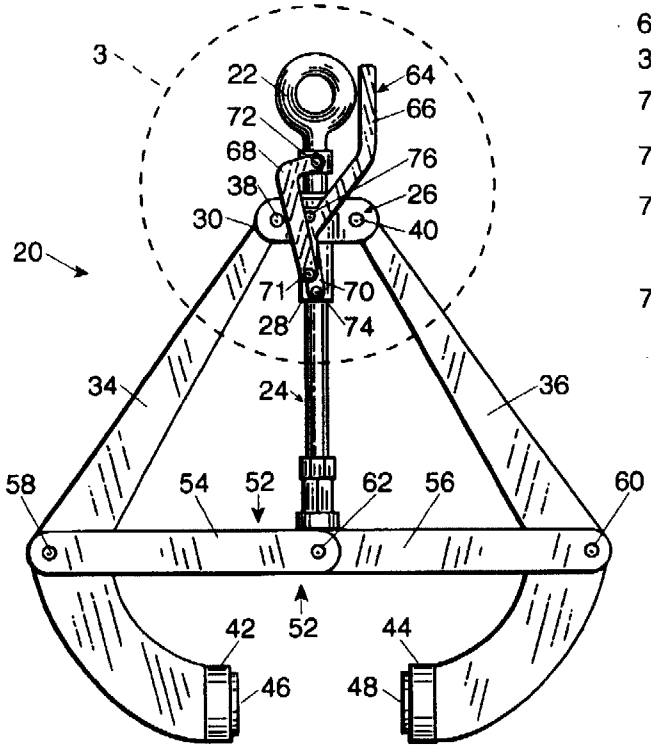
FIG. 1 is a side elevational view of a gripping device made in accordance with the invention with an arm link assembly drawn in a release position.

A slider assembly 26 disposed axially on the shaft 24 comprises a cylindrical collar 28 and a pair of lugs 30, 32 extending transversely to the shaft 24 and on opposite sides of the collar 28. Only one lug 30 is shown in FIGS. 1 and 2, the other lug 32 being hidden from view behind the lug 30. It will be understood that the lugs 30, 32 and the cylindrical collar 28 together define one body (the slider assembly 26) which slides axially on the shaft 24. Lifting arms 34, 36 are pivotally mounted at respective ends on pivots 38, 40 to the lugs 30, 32 of the slider assembly 26 and are disposed on opposite sides of the shaft 24. It will be understood that the pivots 38, 40 each traverse the lugs 30, 32 and a respective arm 34,36.

The operatively-lower ends of the arms 34, 36 have a generally arcuate shape and the arms are disposed so that the ends curve toward each other. The arms 34, 36 terminate in respective grips 42, 44 which retain respective grip pads 46, 48. The grip pads 46, 48 are made of smooth polished resin material selected to minimize abrasion on smooth planar surfaces such as a monument 50 of polished granite. The grip pads 46, 48 are pivotally received inside the grips 42, 44 using a centrally located fastener (not shown) so that their relative angular disposition will self-adjust when applied to a load. The pads 46 and 48 may also be replaced when worn or damaged, as necessary. It will be understood that other terminations may be formed on the ends of the arms in accordance with the nature of the load to be gripped.

An arm link assembly generally indicated by numeral 52 is provided to close the arms 34, 36 to grip a load as shown in FIG. 2 or to separate the arms to receive a load as shown in FIG. 1. The arm link assembly 52 comprises first and second link pairs 54, 56 of which each pair is pivotally mounted on respective pivots 58, 60 to the arms 34, 36 and to a common pivot 62 on the end of the shaft 24 opposite from the eye 22. It will be understood that only one link of each link pair 54, 56 is shown in the drawings of FIGS. 1 and 2, the other link of each link pair being hidden from view and on the opposite side of the associated arms 34, 36.

The gripping device described thus far is of a kind which is generally well-known and of which many equivalent structures are known. In essence, the operation of the device consists in positioning the grip pads in the spaced-apart configuration of FIG. 1 on opposite sides of a load. The pads will be spaced from the load until the shaft 24 is hoisted by a crane or some other lifting apparatus. As the shaft 24 is raised, the link pairs 54, 56 pivot on their common pivot 62 thereby bringing the lifting arms 34, 36 closer together as they pivot on respective pivots 38, 40. Eventually, the grip p ads 46, 48 are brought into engagement with the load or monument 50 and continued lifting of the shaft 24 will raise the load which is held by friction between the grip pads.

The problem which is addressed by this invention is that of maintaining the lifting arms 34,36 in a spaced-apart configuration so that the grip pads 46, 48 may be properly positioned about the load prior to raising it. Positive locking devices to maintain the arms in a spaced-apart configuration are found in the prior art, as mentioned above, and commonly require at least two operators. One operator must physically space the arms apart which otherwise are naturally inclined to come together under their own weight while the other operator engages the lock.

In accordance with the invention, there is provided an over-center clamp which is generally indicated in the drawings by numeral 64 and which is operable to move the arm link assembly 52 into the gripping position of FIG. 2 and also to releasably retain the arm link assembly in the load-receiving or release position shown in FIG. 1. The over-center clamp is comprised of an actuating lever 66 and a pair of links 68, 70.

Figure 3:
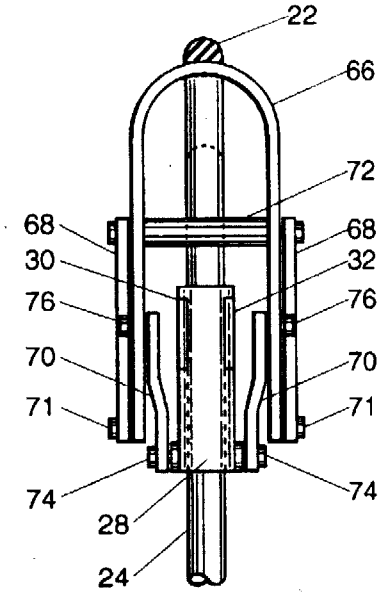
FIG. 3 is an end elevation of area 3 shown in FIG. 1.

The actuating lever 66 is in the form of a handle (FIG. 3) of U-shape configuration and is pivoted at its ends on pivot 71 to the first link 68 which, in turn, is pivotally connected on pivot 72 to the shaft 24 just below the eye 22. The second link 70 is pivotally connected on pivot 74 to the collar 28 on the slider 26 and the other end of the link 70 is pivotally connected on pivot 76 to an intermediate portion of the actuating lever 66.

The pivot 72 on the shaft 24 and the pivot 74 on the slider 26 define the center of equilibrium for the over-center clamp 64.

In use, the over-center clamp 64 is moved by a single operator between a release configuration (FIG. 1) and a gripping configuration (FIG. 2) by lifting and pulling the handle or actuating lever 66, as the case may be. It will be seen that the handle 66 is down in the gripping position of the arm link assembly 52 shown in FIG. 2 and is up in the release position shown in FIG. 1. Lifting the handle 66 from the FIG. 2 position causes the clamp 64 to simultaneously pivot on pivot 76 while raising the slider assembly 26 so that the slider 26 is pulled upwardly toward the pivot 72 fixed to the shaft 24. The motion of the handle or actuating lever 66 is limited by the arc described by the second link 70 as the link rotates on the pivot 74 by which it is attached to the slider 26. As its highest point, the link 70 is aligned with the shaft 24, the center of equilibrium for the clamp 64 and the arm link assembly 52 has been brought to the release position of FIG. 1.

It will be seen that the first link 68 is curved to accommodate the actuating lever 66 when the second link 70 is moved over the center of equilibrium and the handle or actuating lever 66 has a bend so that it is out of alignment with the shaft when it has been lifted and it may easily be grasped.

The actuating lever 66 and the first link 68 are also shaped so that, once the link 70 crosses this equilibrium line, the pivot connection 76 on the actuating lever 66 comes into engagement with the first link 68 thereby stopping the clamp from pivoting any further and maintaining the release position of the arm link assembly 52.

When the gripping device 20 is properly positioned on a load, the handle or actuating lever 66 needs merely to be tugged away from the shaft 24 and pulled down. This motion of the actuating lever 66 pulls the second link 70 over the center of equilibrium releasing the slider assembly 26 to slide down the shaft 24 and to allow the lifting arms 34, 36 to freely pivot on their respective pivots 38, 40 and come into engagement with the load.

It will be understood that several variations may be made to the above-described embodiment of the invention within the scope of the appended claims and that, for example, the configuration of the arm link assembly 52 may vary in well-known manner, the lifting arms 34, 36 may have a common pivot on a slider, and the over-center clamp may likewise have alternative configurations known in other applications.

I claim:

1. A gripping device having a pair of lifting arms pivotally mounted to a first body for relative rotational movement to each other and having free ends spaced from each other and adapted to receive a load therebetween;

an arm link assembly coupled to the arms and to a second body, the arm link assembly being movable between a first position to close the arms to grip a load and a second position to separate the arms to receive a load; and an over-center locking clamp coupled to said first and second bodies, the over-center locking clamp comprising a first link pivotally connected at one end to the second body on a first pivot, an actuating lever being pivotally connected to the other end of said first link, and a second link pivotally connected at one end to the first body on a second pivot, the other end of said second link being pivotally connected to an intermediate portion of said actuating lever, the over-center locking clamp being operable to move the arm link assembly into the first position and to releasably retain the arm link assembly in the second position.

2. A gripping device having a pair of lifting arms pivotally mounted to a first body for relative rotational movement to each other and having free ends spaced from each other and adapted to receive a load therebetween;

an arm link assembly coupled to the arms and to a second body, the arm link assembly being movable between a first position to close the arms to grip a load and a second position to separate the arms to receive a load; and an over-center locking clamp coupled to said first and second bodies and operable to move the arm link assembly into the first position and to releasably retain the arm link assembly in the second position;

wherein the second body is a suspension structure and the arm link assembly moves into said first position upon lifting the device using the suspension structure.

3. A gripping device having a pair of lifting arms pivotally mounted to a first body for relative rotational movement to each other and having free ends spaced from each other and adapted to receive a load therebetween;

an arm link assembly coupled to the arms and to a second body, the arm link assembly being movable between a first position to close the arms to grip a load and a second position to separate the arms to receive a load; and an over-center locking clamp coupled to said first and second bodies and operable to move the arm link assembly into the first position and to releasably retain the arm link assembly in the second position, wherein the over-center locking clamp comprises a first link pivotally connected at one end to the second body on a first pivot, an actuating lever being pivotally connected to the other end of said first link, and a second link pivotally connected at one end to the first body on a second pivot, the other end of said second link being pivotally connected to an intermediate portion of said actuating lever.

4. In a gripping device having a body associated with coupling means adapted to support a load;

a slider relatively movable to said body;

a pair of lifting arms transversely disposed on opposite sides of said body, each arm having an end pivotally secured to the slider and a free end adapted to engage a load to be gripped between said arms in a gripping configuration when said slider moves in a first direction;

the improvement in which an over-center locking assembly is provided to lock said arms in a release configuration to receive a load, the center of equilibrium for the over-center locking assembly being defined by a first pivot secured to said body and by a second pivot secured to said slider, an actuating lever forming part of said over-center locking assembly being pivotally connected to said second pivot by at least one link, the actuating lever being adapted to pull said slider in a second direction opposite to said first direction, and to thereby release said arms from a load being gripped; stop means lying in the path of movement of the actuating lever to arrest continued pivotal movement of the actuating lever when said at lest one link is moved over the center of equilibrium from one side of said body to the other side of said body and to maintain said arms in a stable release configuration.

5. Gripping device according to claim 4 in which the over-center locking assembly comprises a first link pivotally connected at one end to said body on said first pivot, the actuating lever being pivotally connected to the other end of said first link, and a second link pivotally connected at one end to said slider on said second pivot, the other end of said second link being pivotally connected to an intermediate portion of said actuating lever.

6. In a gripping device having an elongated shaft with coupling means at one end adapted to support a load;

a slider axially movable on said shaft;

a pair of lifting arms transversely disposed on opposite sides of said shaft, each arm having an end pivotally secured to the slider and a free end adapted to engage a load to be gripped between said arms;

and a pair of arm links each pivotally secured at one end to said shaft and pivotally secured at the other end to an intermediate portion of said arms and adapted to move with the arms between a gripping configuration to grip a load and a release configuration to receive a load;

the improvement in which an over-center locking assembly is provided to lock said arms in a release configuration, the center of equilibrium for the over-center locking assembly being defined by a first pivot forming part of the over-center locking assembly and secured to said shaft between said coupling means and said slider and by a second pivot secured to said slider;

an actuating lever forming part of said over-center locking assembly being pivotally connected to said second pivot by at least one link, the actuating lever being adapted to pull said slider axially on said shaft toward said coupling means, and to thereby release said arms from a load;

stop means lying in the path of movement of the actuating lever to arrest continued pivotal movement of the actuating lever when said at least one link is moved over the center of equilibrium from one side of said shaft to the other side of said shaft and to maintain said arms in a stable release configuration.

7. Gripping device according to claim 6 in which the over-center locking assembly comprises a first link pivotally connected at one end to said shaft on said first pivot, the actuating lever being pivotally connected to the other end of said first link, and a second link pivotally connected at one end to saidslider on said second pivot, the other end of said second link being pivotally connected to an intermediate portion of said actuating lever.

8. Gripping device according to claim 7 in which the stop means are defined by said first link lying in the path of movement of the actuating lever.

9. Gripping device according to claim 8 in which the first link is curved to accommodate the actuating lever when the second link is moved over the center of equilibrium.

10. A gripping device having a pair of lifting arms pivotally mounted to a first body for relative rotational movement to each other and having free ends spaced from each other and adapted to receive a load there between;

an arm link assembly coupled to the arms and to a second body comprising a suspension structure, the arm link assembly being movable between a first position to close the arms to grip a load upon lifting the device using the suspension structure and a second position to separate the arms to receive a load; and an over-center locking clamp coupled to said first and second bodies and operable to move the arm link assembly into the first position and to releasably retain the arm link assembly in the second position.

* * * * *